US006542027B2

(12) United States Patent
Zha et al.

(10) Patent No.: US 6,542,027 B2
(45) **Date of Patent: *Apr. 1, 2003**

(54) BANDGAP REFERENCE CIRCUIT WITH A PRE-REGULATOR

(75) Inventors: Gang Zha, Shenzhen (CN); Solomon K. Ng, Shenzhen (CN)

(73) Assignee: Shenzhen STS Microelectronics Co. Ltd, Shenzhen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/989,221

(22) Filed: Nov. 20, 2001

(65) Prior Publication Data

US 2002/0050854 A1 May 2, 2002

Related U.S. Application Data

(63) Continuation of application No. 09/643,171, filed on Aug. 21, 2000, now Pat. No. 6,344,770.

(30) Foreign Application Priority Data

Sep. 2, 1999 (CN) ..... 99118480

(51) Int. Cl.[7] ..... G05F 1/563

(52) U.S. Cl. ..... 327/540; 327/513; 323/314

(58) Field of Search ..... 327/538, 539, 327/540, 513; 323/313.314, 315, 907

(56) References Cited

U.S. PATENT DOCUMENTS

| | | | | | |
|---|---|---|---|---|---|
| 4,749,889 | A | * | 6/1988 | Lagoni et al. | 327/513 |
| 5,576,616 | A | * | 11/1996 | Ridgers | 323/314 |
| 5,631,551 | A | * | 5/1997 | Scaccianoce et al. | 323/281 |
| 5,686,823 | A | * | 11/1997 | Rapp | 323/313 |
| 5,920,184 | A | * | 7/1999 | Kadanka | 323/314 |
| 5,936,392 | A | * | 8/1999 | Taylor | 327/543 |
| 5,952,873 | A | * | 9/1999 | Rincon-Mora | 327/539 |
| 6,023,185 | A | * | 2/2000 | Galipeau et al. | 327/513 |
| 6,114,897 | A | * | 9/2000 | Ham | 327/427 |
| 6,411,154 | B1 | * | 6/2002 | Mikulenka | 327/538 |

* cited by examiner

*Primary Examiner*—Timothy P. Callahan
*Assistant Examiner*—Terry L. Englund
(74) *Attorney, Agent, or Firm*—Lisa K. Jorgenson; William J. Kubida

(57) ABSTRACT

A bandgap reference circuit has a pre-regulator that achieves a low temperature coefficient through the use of a first component that generates a first voltage having a negative temperature coefficient and a second component coupled in series to the first component and which generates a second voltage having a positive temperature coefficient. This low temperature coefficient in the pre-regulator allows the bandgap reference circuit to output the bandgap voltage $V_{BG}$ with a low temperature coefficient.

11 Claims, 2 Drawing Sheets

BANDGAP REFERENCE CIRCUIT WITH A PRE-REGULATOR

CROSS REFERENCE TO RELATED APPLICATIONS

This application is a continuation of U.S. patent application Ser. No. 09/643,171, now U.S. Pat. No. 6,344,770, filed Aug. 21, 2000 and entitled "BANDGAP REFERENCE CIRCUIT WITH A PRE-REGULATOR," which is specifically incorporated herein by reference.

TECHNICAL FIELD OF THE INVENTION

This invention relates in general to bandgap reference circuits and, more specifically, to devices and methods for providing bandgap reference circuits with low temperature coefficients.

BACKGROUND OF THE INVENTION

As shown in FIG. 1, a conventional bandgap reference circuit 10 includes a pre-regulator 12 that generates a regulated voltage $V_{REG}$ off the supply voltage $V_{CC}$ using a pair of current-mirror transistors Q1 and Q2, a resistor R1, and a set of series-connected diodes D1, D2, and D3. In addition, a start-up circuit 14—consisting of a bias transistor Q3, another set of series-connected diodes D4 and D5, and a resistor R2—biases a pair of $V_{BE}$-differential transistors Q4 and Q5 at start-up, after which the transistor Q3 shuts off, thereby effectively isolating the start-up circuit 14 from the rest of the bandgap reference circuit 10.

Together, a current source transistor Q9 and a $V_{BE}$-differential circuit 16 generate a differential voltage $V_{DIF}$ having a positive temperature coefficient from the regulated voltage $V_{REG}$ using a pair of current-mirror transistors Q6 and Q7, the $V_{BE}$-differential transistors Q4 and Q5, a pair of resistors R3 and R4, and a driver transistor Q8. As a result, the bandgap voltage $V_{BG}$ output from the bandgap reference circuit 10 across a resistor R5 equals the differential voltage $V_{DIF}$ plus the base-emitter voltage $V_{BE}$ of the transistor Q5. Because the base-emitter voltage $V_{BE}$ has a negative temperature coefficient, any variations in the base-emitter voltage $V_{BE}$ due to temperature are countered by variations in the differential voltage $V_{DIF}$, so that the bandgap voltage $V_{BG}$ should be relatively temperature independent. Unfortunately, the negative temperature dependence of the diodes D1, D2, and D3 makes the regulated voltage $V_{REG}$ relatively temperature dependent, which, in turn, makes the bandgap voltage $V_{BG}$ relatively temperature dependent.

Accordingly, there is a need in the art for an improved bandgap reference circuit that has a low temperature coefficient.

SUMMARY OF THE INVENTION

In accordance with this invention, a pre-regulator for generating a regulated voltage for use in generating a bandgap voltage from a bandgap reference circuit includes a current source (e.g., a wilson current source) and a $V_{BE}$ multiplier that receives current therefrom and generates/clamps the regulated voltage. Also, feedback circuitry regulates the current flow from the current source in response to feedback from the bandgap voltage.

In other embodiments of this invention, the pre-regulator described above is incorporated into a bandgap reference circuit.

In still another embodiment of this invention, a reference voltage is generated by driving a current into a $V_{BE}$ multiplier to generate and clamp a regulated voltage. The current is regulated in response to feedback from the reference voltage. Also, a $V_{BE}$ differential voltage is generated from the regulated voltage using a $V_{BE}$ differential circuit, and the reference voltage is generated from the $V_{BE}$ differential voltage and a base-emitter voltage drop.

DETAILED DESCRIPTION OF THE ILLUSTRATED EMBODIMENTS

Figure 2:
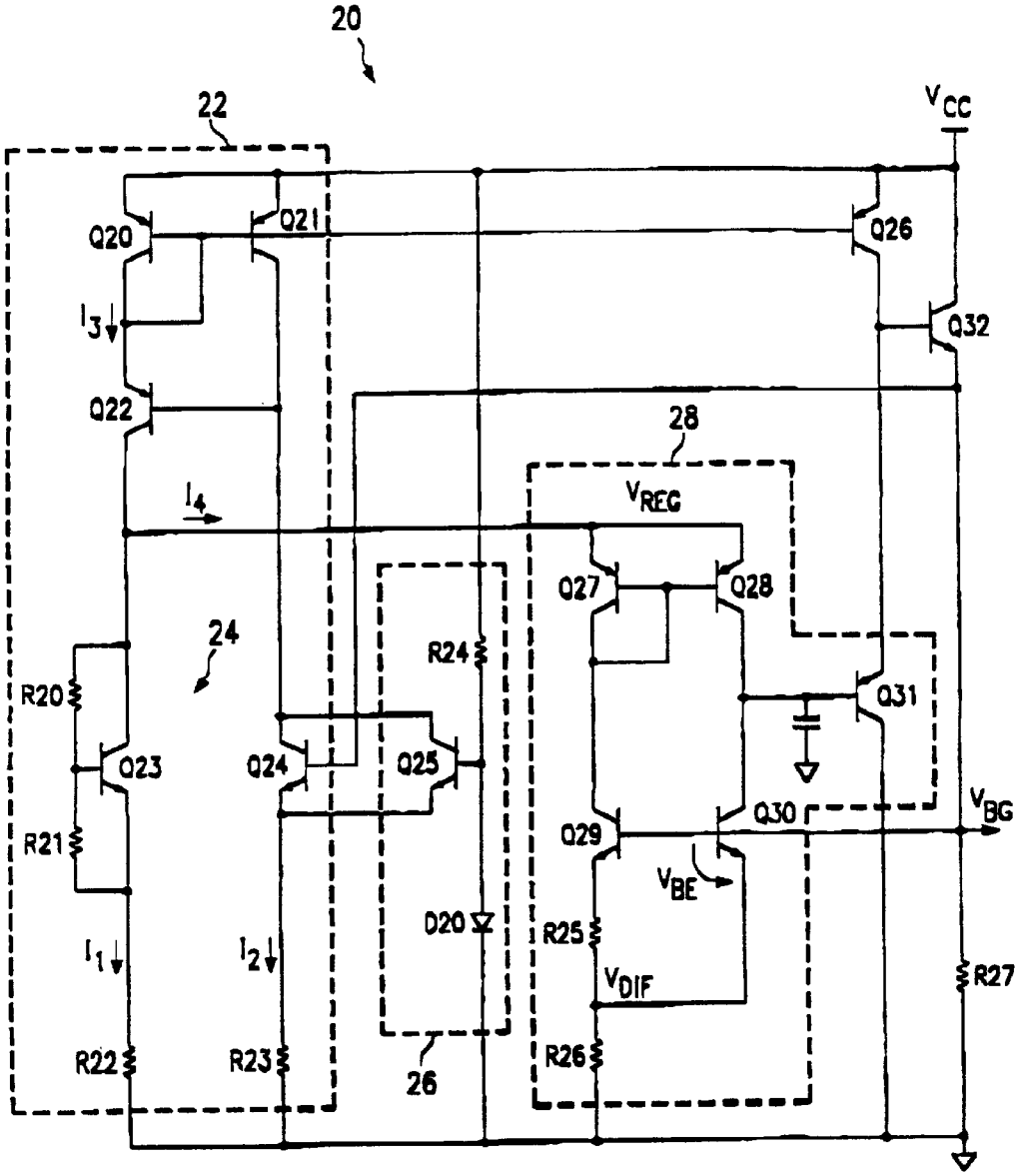
FIG. 2 is a circuit schematic illustrating a bandgap reference circuit in accordance with this invention.

As shown in FIG. 2, a bandgap reference circuit 20 in accordance with this invention includes a pre-regulator 22 that generates a regulated voltage $V_{REG}$ off the supply voltage $V_{CC}$ using a set of Wilson current source transistors Q20, Q21, and Q22, a $V_{BE}$-multiplier 24 (consisting of a pair of resistors R20 and R21 and a transistor Q23), a feedback transistor Q24, and a pair of bias resistors R22 and R23. In addition, a start-up circuit 26—consisting of a bias transistor Q25, a diode D20, and a resistor R24—draws current from the Wilson current source transistors Q20, Q21, and Q22 at start-up. Once the bandgap voltage $V_{BG}$ is established, the transistor Q25 shuts off.

Together, a current source transistor Q26 and a $V_{BE}$-differential circuit 28 generate a differential voltage $V_{DIF}$ having a positive temperature coefficient from the regulated voltage $V_{REG}$ using a pair of current-mirror transistors Q27 and Q28, a pair of $V_{BE}$-differential transistors Q29 and Q30, a pair of resistors R25 and R26, and a driver transistor Q31. As a result, the bandgap voltage $V_{BG}$ output from the bandgap reference circuit 20 across a resistor R27 equals the differential voltage $V_{DIF}$ plus the base-emitter voltage $V_{BE}$ of the transistor Q30. Because the base-emitter voltage $V_{BE}$ has a negative temperature coefficient, any variations in the base-emitter voltage $V_{BE}$ due to temperature are countered by variations in the differential voltage $V_{DIF}$, so that the bandgap voltage $V_{BG}$ is relatively temperature independent. An output transistor Q32 provides current to the bandgap voltage $V_{BG}$.

Figure 1:
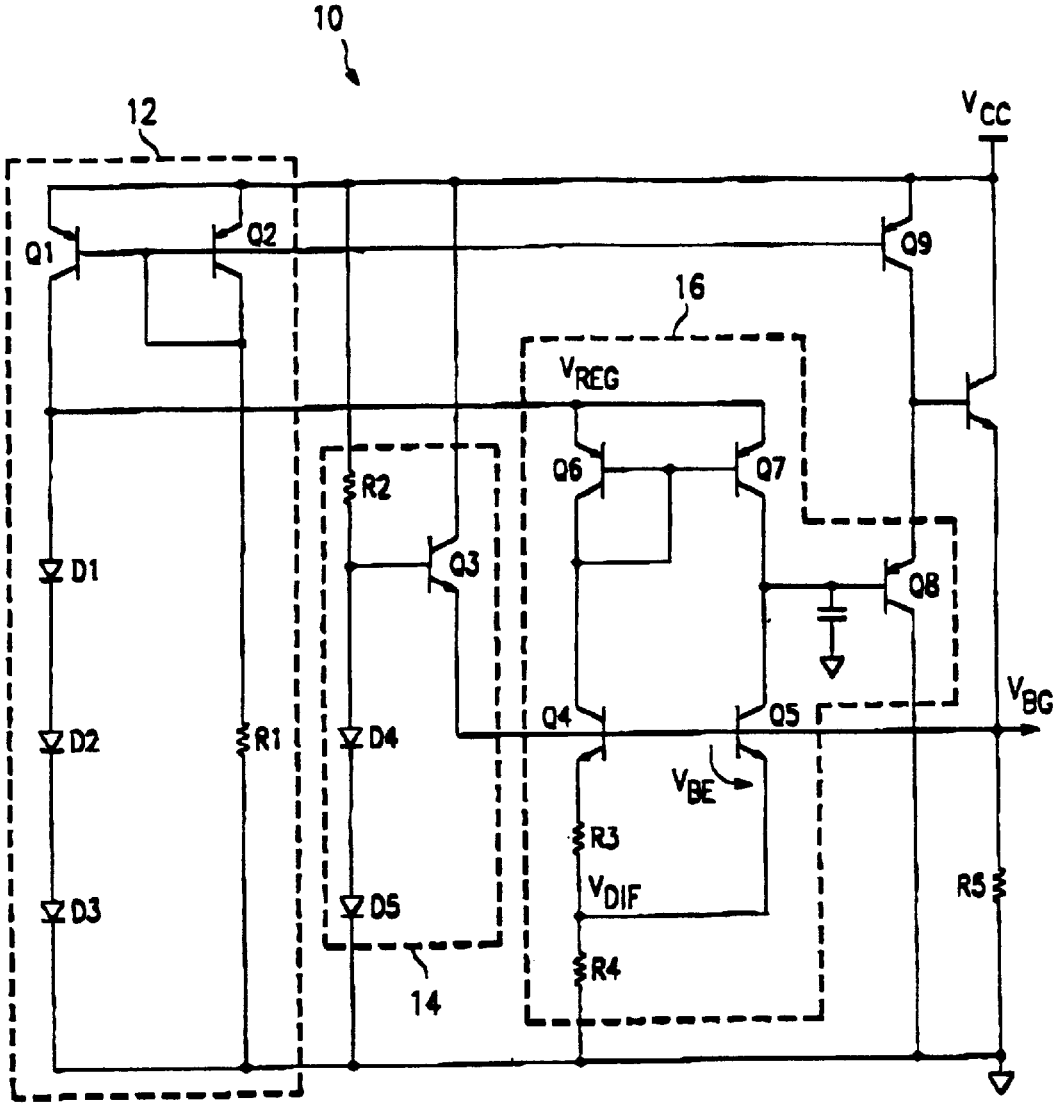
FIG. 1 (PRIOR ART)
FIG. 1 is a circuit schematic illustrating a conventional bandgap reference circuit.

The improved pre-regulator 22 gives the bandgap reference circuit 20 a lower temperature coefficient than the conventional bandgap reference circuit 10 (see FIG. 1) previously described by providing a regulated voltage $V_{REG}$ with a lower temperature coefficient. Specifically, the temperature coefficient $T_C$ of the regulated voltage $V_{REG}$ can be calculated as follows.

The currents $I_1$, $I_2$, $I_3$, and $I_4$ can be determined as follows:

$$I_2=(V_{BG}-V_{BE})/R23 \quad (1)$$

$$I_3=N(V_{BG}-V_{BE})/R23 \quad (2)$$

where N is the size of the transistor Q20 relative to the transistor Q21, $$I_4 = 2(V_{BEQ30} - V_{BEQ29})/R25 \quad (3)$$

$$= 2V_T \ln(A)/R25 \quad (4)$$

where A is the size of the transistor Q29 relative to the transistor Q30, $$I_1 = I_3 - I_4 \quad (5)$$

$$= (N(V_{BG} - V_{BE})/R23) - (2V_T \ln(A)/R25) \quad (6)$$

In addition, the regulated voltage $V_{REG}$ can be calculated as follows:

$$V_{REG} = (1+m)V_{BE} + I_1 R22 \quad (7)$$

$$= (1+m)V_{BE} + (N(R22/R23))(V_{BG} - V_{BE}) - 2V_T \ln(A)(R22/R25) \quad (8)$$

$$= NV_{BG}(R22/R23) + (1+m-N(R22/R23))V_{BE} - 2V_T \ln(A)(R22/R25) \quad (9)$$

where m is the value of the resistor R20 relative to the resistor R21.

Further, the temperature coefficient $T_C$ can be calculated as follows:

$$T_c = dV_{REG}/dT \quad (10)$$

$$= (1+m-N(R22/R23))(dV_{BE}/dT) - 2\ln(A)(R22/R25)((dV_T/dT) \quad (11)$$

Setting $T_C$=0, and assuming $dV_{BE}/dT$=−2 mV/° C. and $dV_T/dT$=0.086 mV/° C., we find the following:

$$(1+m-N(R22/R23))/(2ln(A)(R22/R25))=(dV_T/dT)/(dV_{BE}/dT)=-0.086/2 \quad (12)$$

We can then calculate appropriate values for m, N, R22, R23, A, and R25 from equations (9) and (12) above so as to achieve the desired regulated voltage $V_{REG}$ and a zero (or close to zero) temperature coefficient $T_C$. For example, a regulated voltage $V_{REG}$ of 1.66V and a temperature coefficient $T_C$ of 0.09 mV/° C. can be achieved with N=2, A=6, m=0.4, R22, R23=8 KOhms, and R25=2.4 KOhms.

This invention thus provides a low temperature coefficient bandgap reference circuit. Also, the use of a Wilson current source in the pre-regulator helps the reference circuit achieve a Power Supply Rejection Ratio (PSRR) exceeding 80 dB. Further, the circuit is able to operate using low supply voltages (e.g., $V_{CC}$=2.7 Volts).

Of course, it should be understood that although this invention has been described with reference to bipolar transistors, it is equally applicable to other transistor technologies, including MOSFET technologies.

Although this invention has been described with reference to particular embodiments, the invention is not limited to these described embodiments. Rather, the invention is limited only by the appended claims, which include within their scope all equivalent devices and methods that operate according to the principles of the invention as described.

What is claimed is:

1. A temperature compensated pre-regulator for generating a regulated voltage having a low temperature coefficient for use in generating a reference voltage, the pre-regulator comprising:

a current source;

a first component comprising a $V_{BE}$ multiplier coupled to the current source and which generates a first voltage having a negative temperature coefficient; and a second component coupled in series to said first component and coupled in series to said current source and which generates a second voltage having a positive temperature coefficient, wherein said regulated voltage comprises a combination of said first and second voltages; and a node directly coupling said regulated voltage to an external regulator circuit, wherein the external regulator circuit generates said reference voltage.

2. The pre-regulator of claim 1, wherein said second component comprises a proportional-to-absolute-temperature (PTAP) circuit.

3. The pre-regulator of claim 1, wherein said current source comprises a Wilson current source.

4. The pre-regulator of claim 1, further comprising feedback circuitry coupled to the current source for regulating the current flow therefrom directly in response to feedback from the reference voltage.

5. A circuit for generating a reference voltage, the circuit comprising:

(a) a temperature compensated pre-regulator for generating a regulated voltage having a low temperature coefficient, the pre-regulator including:

a current source;

a first component comprising a $V_{BE}$ multiplier coupled to the current source and which generates a first voltage having a negative temperature coefficient; and a second component coupled in series to said first component and coupled in series to said current source and which generates a second voltage having a positive temperature coefficient, wherein said regulated voltage comprises a combination of said first and second voltages;

(b) a $V_{BE}$ differential circuit coupled directly to the regulated voltage of a pre-regulator node for generating a $V_{BE}$ differential voltage from the regulated voltage; and (c) output circuitry coupled to the $V_{BE}$ differential circuit for generating the reference voltage from the $V_{BE}$ differential voltage and a base-emitter voltage drop.

6. The circuit of claim 5, wherein said second component comprises a proportional-to-absolute-temperature (PTAP) circuit.

7. The circuit of claim 5, wherein said $V_{BE}$ differential circuit is temperature compensated.

8. The circuit of claim 5, further comprising feedback circuitry coupled to the current source for regulating the current flow therefrom directly in response to feedback from the reference voltage, wherein the feedback circuitry comprises a feedback bipolar transistor.

9. The circuit of claim 5, wherein the output circuitry comprises an output bipolar transistor.

10. A circuit for generating a reference voltage, the circuit comprising:

(a) a temperature compensated pre-regulator for generating a regulated voltage having a low temperature coefficient, the pre-regulator including:

a current source;

a first component coupled to the current source and which generates a first voltage having a negative temperature coefficient; and a second component coupled in series to said first component and coupled in series to said current source and which generates a second voltage having a positive temperature coefficient, wherein said regulated voltage comprises a combination of said first and second voltages;

(b) a $V_{BE}$ differential circuit coupled directly to the regulated voltage of a pre-regulator node for generating a $V_{BE}$ differential voltage from the regulated voltage;

(c) output circuitry coupled to the $V_{BE}$ differential circuit for generating the reference voltage from the $V_{BE}$ differential voltage and a base-emitter voltage drop; and (d) a start-up component coupled to the pre-regulator for drawing current from the current source at start-up.

11. The circuit of claim 10, wherein the start-up component includes a bipolar transistor biased by a resistor connected in series with a diode.

* * * * *